United States Patent [19]

Bannister et al.

[11] Patent Number: 4,841,858

[45] Date of Patent: Jun. 27, 1989

[54] IMPRESSION ROLLER ASSEMBLY INCLUDING AN EJECTOR ROLLER

[76] Inventors: Ray L. Bannister, 14 Capel Lodge, Kew Rd., Richmond, Surrey TW9 3JU; Frederick C. Close, 3 Gypsy Close, Great Amwell, Herts.; Peter J. Loeber, 121 Greenfield, Earith, Cambridgeshire, all of United Kingdom

[21] Appl. No.: 89,640

[22] Filed: Aug. 26, 1987

[30] Foreign Application Priority Data

Aug. 27, 1986 [EP] European Pat. Off. ..... 86306620.5

[51] Int. Cl.[4] ..... B65H 29/20; B41F 21/00

[52] U.S. Cl. ..... 101/232; 101/91; 271/314

[58] Field of Search ..... 101/91, 235, 236, 232; 235/101; 271/273, 274, 314

[56] References Cited

U.S. PATENT DOCUMENTS

| | | | |
|---|---|---|---|
| 1,580,626 | 4/1926 | Payne | 271/314 |
| 1,580,761 | 4/1926 | Payne et al. | 271/314 |
| 1,637,253 | 7/1927 | Friedrichs | 271/274 |
| 2,605,702 | 8/1952 | Thomas | 271/314 X |
| 2,871,781 | 2/1959 | Schrempp | 101/235 |
| 3,037,447 | 6/1962 | Gonzalez et al. | 101/235 X |
| 4,268,163 | 5/1981 | Doi | 271/274 |
| 4,461,212 | 7/1984 | Geney | 271/274 |
| 4,558,373 | 12/1985 | Plascncia | 271/273 |

FOREIGN PATENT DOCUMENTS

| | | | |
|---|---|---|---|
| 825318 | 12/1951 | Fed. Rep. of Germany | 235/101 |
| 188255 | 9/1985 | Japan | 271/273 |
| 482805 | 4/1938 | United Kingdom | 101/91 |
| 645938 | 11/1950 | United Kingdom | 271/274 |
| 721560 | 1/1955 | United Kingdom | 101/91 |

*Primary Examiner*—Clifford D. Crowder

*Attorney, Agent, or Firm*—Michael J. DeSha; David E. Pitchenik; Melvin J. Scolnick

[57] ABSTRACT

An impression roller assembly including an ejector roller for a postage meter or like machine includes a first member pivotable about a substantially horizontal axis, an impression roller carried at or towards the free end of the first member, a second member pivotable relative to the first member about an axis co-incident with the rotation axis of the first impression roller, an ejector roller mounted at or towards the free end of the second member, and means for driving the ejector roller. In use, rotation of the impression roller by the drive of the machine directly or indirectly causes rotation of an ejector roller.

14 Claims, 2 Drawing Sheets

IMPRESSION ROLLER ASSEMBLY INCLUDING AN EJECTOR ROLLER

FIELD OF THE INVENTION

This invention relates to an impression roller assembly, particularly although not exclusively for a postage meter.

Postage meters are known and find wide utility in office and commercial environments.

A postage meter normally includes a print drum driven by a print drum shaft. Rotation of the print drum causes a franking stamp to be applied to an envelope or like relatively flat article such as a package. It is customary to arrange that the print drum make one single revolution per franking operation. Each time the drum rotates, an accounting means, for example a mechanical register or an electronic memory register is adjusted to reflect the expenditure of funds involved in the franking operation.

BACKGROUND OF THE INVENTION AND PRIOR ART

To ensure that the franking stamp on an envelope is clear and legible, it is customary to include an impression roller in a postage meter arranged to exert a supporting force holding the envelope against the print drum while the drum is rotating. In prior art designs of postage meter, see for example U.S. Pat. No. 3,869,986, it has been conventional to include a spring biased swingable impression roller supported on the postage meter frame and located below a lower peripheral portion of the print drum. The same arrangement can be seen in British Pat. No. 1,497,351. In a different kind of postage meter, shown in British Patent application 2,144,081, an impression roller is belt driven and provides a resilient under support for envelopes and the like so that envelopes of different thicknesses can be dealt with. An arrangement of a generally similar kind is to be seen in U.S. Pat. No. 3,823,666 of Hanson. U.S. Pat. No. 2,871,781 of Schrempp shows a letter ejecting device for use with rotary postage printing. A letter (mail piece) is ejected using a spring-driven ejection roller. A platen (impression roller is disposed opposite to a printing cylinder, and drives the ejection roller via a gear train. Other postage meter arrangements are shown in British Pat. No. 3,732,06 and U.S. Pat. No. 1,737,339.

OBJECT OF THE INVENTION

It is an aim of the present invention to provide an improved design of impression roller assembly.

SUMMARY OF THE INVENTION

According to one aspect of the present invention, there is provided an impression roller assembly in which gears are arranged so that in use rotation of an impression roller directly or indirectly causes rotation of an ejector roller.

According to another aspect of the present invention, there is provided an impression roller assembly for use in a machine where it is desired to eject relatively flat articles (such as envelopes or flat packages) after printing, stamping or franking has been applied to them, the assembly including a first member pivotable about a substantially horizontal axis, an impression roller carried at or towards the free end of the first member, a second member pivotable relative to the first member about an axis co-incident with the rotation axis of the impression roller, an ejector roller mounted at or towards the free end of the second member, and means for driving the ejector roller.

BRIEF DESCRIPTION OF THE DRAWINGS

The invention will be better understood from the following non-limiting description of an example thereof given with reference to the accompanying drawings in which.

DETAILED DESCRIPTION OF A PREFERRED EMBODIMENT

Figure 1:
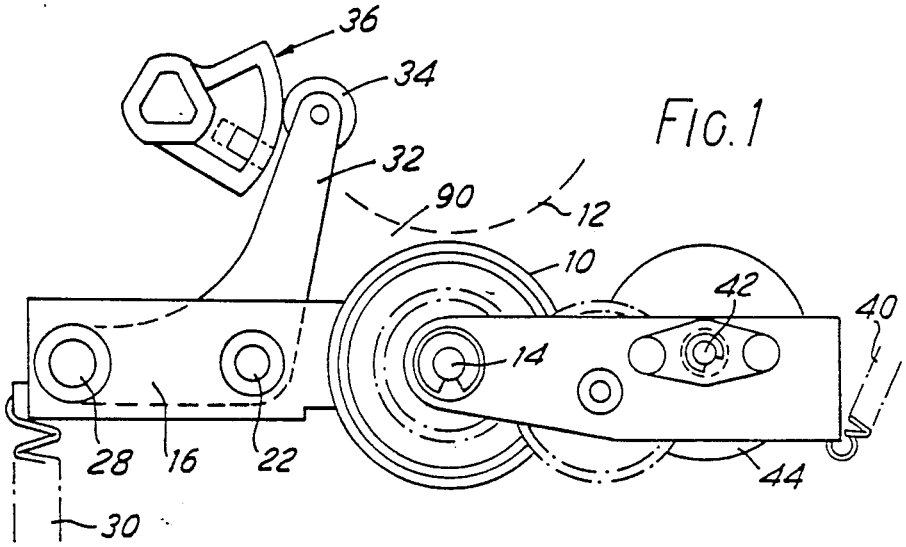
FIG. 1 is a side elevation of one example of impression roller assembly according to one example of the invention.
Figure 2:
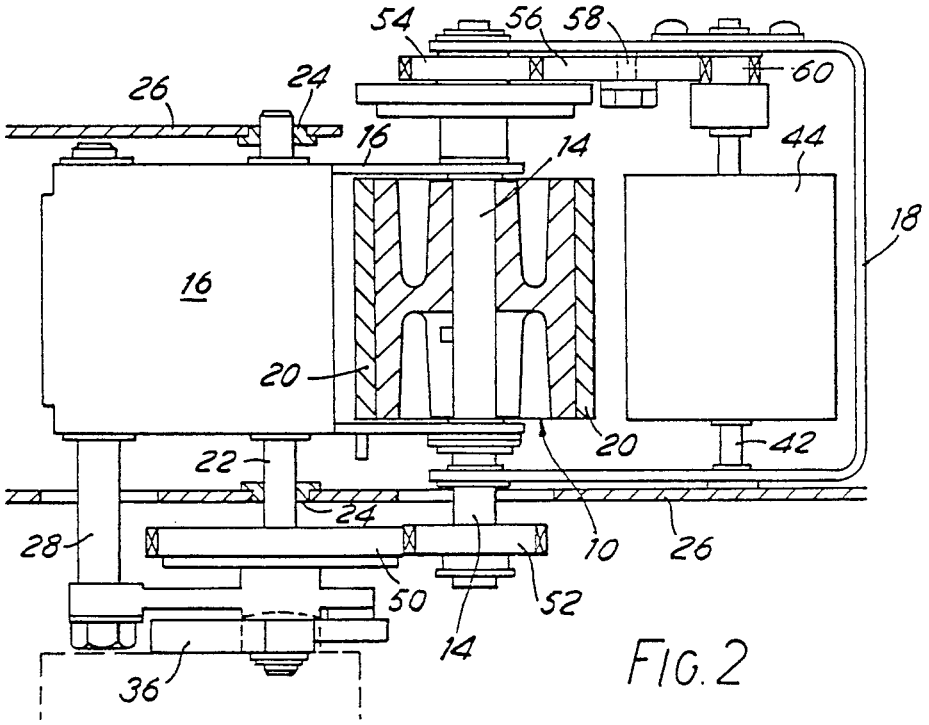
FIG. 2 is a plan view of the assembly shown in FIG. 1.

Referring firstly to FIGS. 1 and 2, the illustrated impression roller assembly includes an impression roller 10 disposed opposite a print drum 12 to define a nip therebetween to receive an envelope or other relatively flat article to be franked. The impression roller 10 is carried on a drivable shaft 14 extending through a first bracket member 16 and also through a second, U-shaped, bracket member 18. The impression roller 10 has a surfacing 20 of rubber or other resilient material. The bracket 16 is carried by, and is mounted for pivotal rotation about, a shaft 22, this shaft being carried by journals 24 which are in turn located in and supported by vertical support walls 26 within the postage meter. A shaft 28 extends laterally from one end of the bracket 16 and this end of the bracket is urged downwardly, that is to say, in an anticlockwise direction of rotation as seen in FIG. 1, by a tension spring 30. The other end of the spring 30 is anchored to a suitable point on the meter chassis (not shown).

Also mounted for pivotal rotation relative to, and about, the shaft 22 is an L-shaped cam follower 32 having a cam follower roller 34. This roller 34 cooperates with a cam 36. The functioning of the cam 36 will be described later.

The U-shaped bracket 18 is freely pivotable about the shaft 14 and is spring urged in an upward direction, anti-clockwise as seen in FIG. 1, by a tension spring 40. The upper end of tension spring 40 is anchored to a suitable abutment within the postage meter base. A shaft 42 is journalled in the U-shaped bracket 18, and on this shaft an ejector roller 44 is mounted. The ejection roller 44 is resiliently biased about an axis parallel to the axis of the print drum 12. The ejector roller itself rotates freely with reference to the shaft 42 but contains a wind-up coil spring arrangement, better seen in FIG. 3, connected to the shaft 42. The manner of functioning of this will be described later.

The shaft 22 carries a gear 50 thereon, which is driven by gearing not shown either directly from an electric motor of the postage meter, or indirectly from said motor via intervening gears or belt drives. The gear 50 is in engagement with a gear 52 which drives the impression roller 10 and also drives a gear 54 on the shaft 14. The gear 54, herein also called a first gear, is in engagement with a further gear 56, herein also called a second gear, freely rotatable relative to a stub shaft which is mounted on the U-shaped bracket 18, the stub shaft being indicated at 58. The gear 56 is in engagement with a further gear 60 (herein also called a third gear) which is attached to and drives the shaft 42.

Figure 3:
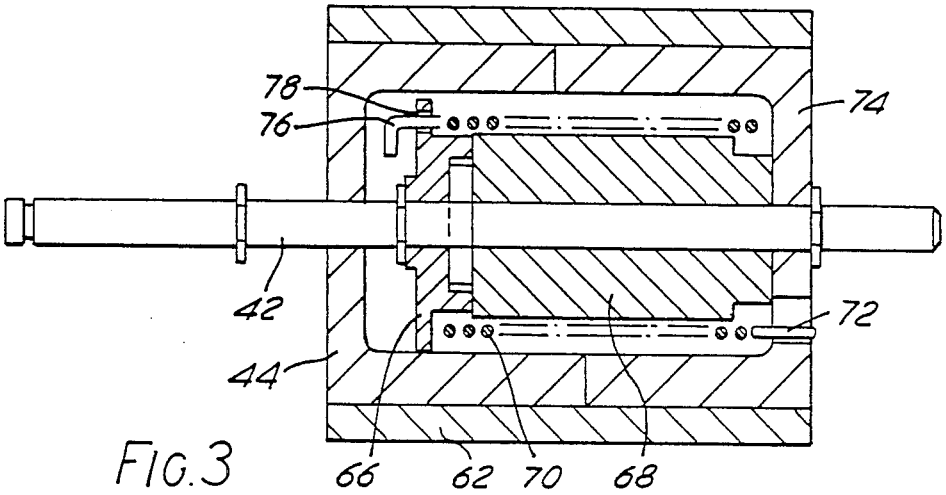
FIG. 3 is an axial cross-section through one example of an ejector roller.
Figure 4:
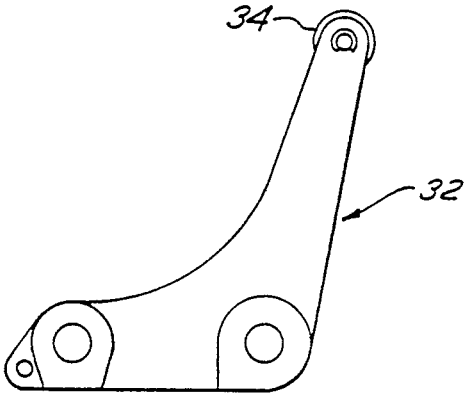
FIGS. 4 and 5 are side and end views of a quadrant cam follower lever used in the assembly shown in FIGS. 1 and 2.
Figure 5:
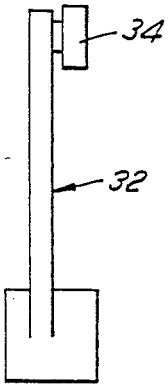

The ejection roller 44, as seen best in FIG. 3, has a surface covering 62 of rubber or like resilient material. Within the ejector roller 44 is housed a disc 66 mounted on and attached to the shaft 42, which placed in end on relationship with a boss 68 carried by and freely rotatable with reference to the shaft 42. A coil spring 70 has one end 72 extending through a small hole in the end wall 74 of the ejector roller and its other end 76 extending through a small hole 78 at the periphery of the disc 66. As will be seen from a consideration of FIG. 3, rotation of the shaft 42 in one direction will wind up or tighten the coil spring 70, providing the roller 44 is held against rotation by frictional grip of its surface 62 against an envelope or like article. When this restraint on the rotation of the ejector roller 44 is removed, then the coil spring 70 unwinds and causes the ejector roller 44 to rotate. In this way, stored energy is placed into the spring by rotation of shaft 42, is stored therein, and is released to effect a rotation of the ejector roller 44 once the restraint on the latter is removed. It will be seen that the co-operation of the shaft 42 and the coil spring 70 constitutes in effect a means for driving the ejector roller. This basic concept is also employed in the device shown in U.S. Pat. No. 2,871,781.

In operation, an envelope or like relatively flat article to be franked is fed to the nip 90, FIG. 1, between the print drum 12 and the impression roller 10. In being fed to the nip, the envelope actuates an envelope trip switch, not shown, which starts the print cycle of the machine. As a consequence, the print drum is driven one revolution and the impression roller 10 is correspondingly driven by the gears 50 and 52, the arrangement preferably being such that the peripheral speeds of the surfaces of the print drum and impression roller at the nip are equal so resulting in even feeding of the envelope. During this rotation of the impression roller 10, the gear train 54, 56, 60 is driven, so driving the shaft 42 and storing energy in the coil spring 70. This occurs because there is a gearing up via the gears 54, 56 and 60 causing the rotational speed of the gear 60 to be three times (for example) that of the gear 54. The envelope travels (downstream) substantially at the speed of the periphery of the impression roller and exerts a frictional braking effect on the periphery of the ejector roller while it is passing through the nip between print drum and impression roller. As a result, the spring in the ejector roller is wound up. At the end of the print drum cycle, the cam 366 is suitably actuated by mechanisms in the meter, rotating the L-shaped lever 32 clockwise as seen in FIG. 1 and hence withdrawing the impression roller 10 downwardly so freeing the envelope from the grip of the nip. This downward movement of the impression roller does not affect the upward spring force acting on the bracket 18 and causing the ejector roller 44 to continue to engage the envelope, but the release of the envelope from the nip 90 removes the restraint on the envelope and the ejector roller is then able to rotate and eject the envelope in a direction to the right as seen in FIG. 1. This ejection is consequently achieved without any separate control system to cause a rotation of the ejector roller at an appropriate time in the print cycle, with resulting reduction in complexity of the meter.

In this specification including the claims, the phrase "a treatment operation as hereinbefore defined" is to be taken to mean a printing, stamping or franking operation.

We claim:

1. An impression roller assembly, for use in a machine capable of ejecting relatively flat articles after a treatment operation, the assembly comprising means mounting a first roller for rotation about a first axis, means mounting a second roller having a surface in the shape of a curved surface of a cylinder and said surface being capable of applying a linear force by friction to eject said flat articles, means mounting said second roller for arcuate movement in an arc of a circle whose centre is colinear with said first axis, drive means for causing said first roller to rotate, and transmission means arranged to effect rotation of the second roller in response to rotation of said first foller.

2. An impression roller assembly for use in a machine where it is desired to eject relatively flat articles after printing, stamping or franking has been applied to them, the assembly including a first member pivotable about a substantially horizontal axis, an impression roller carried at or towards the free end of the first member, a second member pivotable relative to the first member about an axis co-incident with the rotation axis of the impression roller, an ejector roller mounted at or towards the free end of the seond member, and means for driving the ejector roller.

3. An assembly according to claim 2 in which the impression roller is disposed opposite a print drum to define a nip therebetween for reception of the flat article.

4. An assembly according to claim 2 in which the ejector roller is mounted between the limbs of a U-shaped bracket member, the free ends of the limbs thereof being pivotally connected to an impression roller carrying bracket member.

5. An assembly according to claim 4 in which a shaft carrying the impression roller serves as the pivotal connection between the impression roller carrying bracket member and the U-shaped bracket member.

6. An assembly according to claim 4 in which the impression and the ejection rollers are respectively mounted on respective first and second rotatable shafts, and further comprising a first gear mounted on said first shaft, a second gear carried by said U-shaped bracket, and a third gear mounted on said second shaft, the first, second and third gears being intermeshed to transmit rotation from the first to the third gear.

7. An assembly according to claim 6 in which a shaft carrying the impression roller serves as the pivotal connection between the impression roller carrying bracket member and the U-shaped bracket member.

8. A postage meter in combination with an assembly according to claim 1 in which said first roller is mounted in confronting and nip-defining relationship with a print drum of said meter, said combination including means actuated by mechanisms in the meter for moving the said first roller away from the said print drum.

9. A combination according to claim 8 in which said last mentioned means includes a cam co-operating with a cam follower mounted on an L-shaped lever.

10. An impression roller assembly for a postage meter, said postage meter including a print drum (12), an impression roller (10) disposed opposite the print drum to define a nip therebetween to receive an envelope, and an ejection roller (44) disposed downstream from the nip, said ejection roller 44 being mounted on bracket 18 and resiliently biased about an axis parallel to the axis of said print drum, said impression roller assembly comprising:

means for mounting the impression roller (10) so as to alternately grip and release an envelope in the nip; and means for receiving and storing a driving force within the ejection roller (44) when the ejection roller is frictionally restrained from rotation by an envelope which is gripped in the nip by the impression roller and is acting upon the ejection roller;

wherein the stored driving force within the ejection roller is released to drive the envelope further downstream when the envelope is released from the nip by a pivotal movement of the impression roller away from the print drum.

11. An impression roller assembly for a postage meter, said postage meter including a print drum (12), an impression roller (10) disposed opposite the print drum to define a nip therebetween to receive an envelope, and an ejection roller (44) disposed downstream from the nip, said ejection roller 44 being mounted on bracket 18 and resiliently biased about an axis parallel to the axis of said print drum, said impression roller assembly comprising:

means for mounting the impression roller (10) so as to alternately grip and release an envelope in the nip; and means for receiving and storing a driving force within the ejection roller (44) when the ejection roller is frictionally restrained from rotation by an envelope which is gripped in the nip by the impression roller and is acting upon the ejection roller;

wherein the stored driving force within the ejection roller is released to drive the envelope further downstream when the envelope is released from the nip by a pivotal movement of the impression roller away from the print drum; and wherein the means for mounting the impression roller comprises:

a first member pivotable about a first axis, carrying the impression roller at a free end thereof, and biased by a spring so that the impression roller is urged towards the print drum; and a second member pivotable relative to the first member about an axis coincident with the rotation axis of the impression roller, carrying the ejection roller, and biased by a spring so that the ejection roller is urged towards an envelope moving downstream from the nip.

12. An impression roller assembly according to claim 11, further comprising:

a cam (36) activated by mechanisms in the postage meter;

a cam follower lever (32) acting upon the first member to withdraw the impression roller from the nip in response to the cam.

13. An impression roller assembly according to claim 10, further comprising:

means (54, 56, 60) for providing the driving force stored within the ejection roller in response to treatment of an envelope in the nip.

14. An impression roller assembly according to claim 13, wherein the means for receiving and storing the driving force within the ejection roller comprises:

a shaft (42) receiving the driving force and rotatably supporting the ejection roller;

a disc (66) mounted on and attached to the shaft; and a coil spring (70) disposed about the shaft within the ejection roller, said coil spring having one end fixed to the disc and the other end fixed to an end wall (74) of the ejection roller.

* * * * *